United States Patent [19]

Bernard et al.

[11] Patent Number: 4,533,154

[45] Date of Patent: Aug. 6, 1985

[54] CROSS-COUNTRY SKIING ASSEMBLY

[75] Inventors: Jean Bernard; Jean J. A. Beyl, both of Nevers; Christian Campillo, Garchizy; Daniel Le Faou, Varennes Vauzelles, all of France

[73] Assignee: Ste LOOK, Nevers, France

[21] Appl. No.: 471,212

[22] Filed: Mar. 1, 1983

[30] Foreign Application Priority Data

Mar. 5, 1982 [FR] France ..... 82 03673

[51] Int. Cl.[3] ..... A63C 9/00

[52] U.S. Cl. ..... 280/615; 280/635

[58] Field of Search ..... 280/614, 615, 618, 635, 280/636

[56] References Cited

U.S. PATENT DOCUMENTS

| | | | |
|---|---|---|---|
| 2,072,477 | 3/1937 | Dodd | 280/614 |
| 3,003,777 | 10/1961 | Hilding | 280/614 |
| 4,128,257 | 12/1978 | Zoor | 280/614 |
| 4,191,396 | 3/1980 | Biermann et al. | 280/618 |

FOREIGN PATENT DOCUMENTS

| | | | |
|---|---|---|---|
| 131617 | 2/1933 | Austria | 280/615 |
| 294710 | 4/1932 | Italy | 280/615 |
| 68111 | 7/1944 | Norway | 280/615 |

*Primary Examiner*—Joseph F. Peters, Jr.
*Assistant Examiner*—Ross Weaver
*Attorney, Agent, or Firm*—Young & Thompson

[57] ABSTRACT

The cross-country skiing assembly comprises a ski shoe and a ski binding for fixing the shoe on a ski. A toe block at the front end of the shoe has a fastening contour which is capable of cooperating with a complementary fastener on a shoe-retaining stirrup of the ski binding. A spring-loaded locking and releasing lever of the ski binding permits automatic positioning of the ski shoe by downward engagement. The shoe-retaining stirrup is pivotally mounted on a cross-pin which is adjacent to the front end face of the toe block.

9 Claims, 10 Drawing Figures

CROSS-COUNTRY SKIING ASSEMBLY

This invention relates to a cross-country skiing assembly comprising a light ski boot or so-called ski shoe and to a ski binding device for fastening the toe end of the shoe on a ski.

In the first two embodiments of a cross-country skiing assembly described in French Pat. No. 824,863 (FIGS. 1 to 3 and FIG. 4), the toe end of the sole of the ski shoe is provided with an added element consisting of two vertically-disposed cylindrical members. The ski binding device comprises a plate fixed on the ski and provided with two vertical tubes adapted to receive the cylindrical members which are carried by the ski shoe and fitted within said tubes by downward engagement. After positioning of the shoe within the ski binding, a small spring which cooperates with a hole formed in the added element of the ski shoe prevents upward disengagement of this latter.

This type of assembly for cross-country skiing is very advantageous since the ski shoe can be placed within the binding in a natural and convenient downward movement. Unfortunately, this convenience of shoe engagement is not fully satisfactory since it proves necessary to maintain the small locking spring withdrawn during this operation and to release the spring after engagement of the shoe. A further point is that lifting of the heel during ski-walking is limited by reason of the rigidity of the coupling produced by engagement of the front end of the shoe within the ski binding. During use, this coupling is subjected to relatively high stresses, thus making it necessary to employ high-strength materials (metal) which are therefore heavy and costly.

For these reasons, the cross-country skiing assembly which has just been described is ill-suited to present-day requirements. The cross-country skier of to-day desires an inexpensive and lightweight assembly which is convenient to use while providing high performance and efficiency together with a substantial amplitude of lift of the heel.

Another example of such a cross-country ski assembly may be found in U.S. Pat. No. 4,191,396. In this case a substantial extension is provided at the toe end of the sole and is so designed as to fit within a housing of complementary shape which is pivotally mounted on the ski. This articulation permits correct lifting of the heel during ski-walking. However, the position of the axis of articulation is located beyond the sole extension in the forward direction and consequently well ahead of the toe, with the result that the skier cannot "ski-walk" naturally or travel efficiently. Practical tests have in fact shown that the ideal position for the axis of pivotal movement of the shoe on a cross-country ski is located at a point corresponding exactly to the skier's toe. Furthermore, positioning of the shoe within the ski binding is carried out in the forward direction, which is not very convenient since the ski is liable to slide forward during this operation. A final point worthy of note is that a sole extension at the front end of a ski shoe is not only unattractive but also constitutes a hindrance for the skier when he or she is not on skis, in particular for normal walking and car-driving.

In order to complete this brief survey of the prior art, the following patents may also be cited: Swiss Pat. No. 201,026, French Pat. No. 2,200,026 and U.S. Pat. No. 4,165,888. These earlier specifications relate to cross-country ski bindings in which the shoe-retaining stirrup is pivotally mounted on the ski in a zone adjacent to the skier's toe. None of these patents disclose or make any provision for automatic downward positioning of the shoe in the ski binding.

The present invention proposes to construct a cross-country skiing assembly in which, as in French Pat. No. 824,863 cited in the foregoing, positioning of the shoe within the ski binding is carried out by downward engagement. This positioning operation is fully automatic or in other words does not require any manual intervention on the part of the skier. Once the shoe is in position within the ski binding, said binding is capable of pivotal displacement on the ski with substantial amplitude in a zone adjacent to the skier's toe.

To this end, the cross-country skiing assembly according to the invention in which the front portion of the ski shoe has a male or female fastening contour whilst the ski binding device comprises a shoe-retaining stirrup of complementary shape is distinguished by the fact that the shoe-retaining stirrup is pivotally mounted on the ski by means of a transverse pivot-pin placed immediately in front of the tip of the ski shoe. Provision is essentially made for a locking member acted upon by an elastic element and adapted to cooperate with the front portion of the ski shoe in such a manner as to permit automatic positioning of said shoe by downward engagement within the shoe-retaining stirrup and to prevent withdrawal of said shoe under an upwardly directed force.

In order to thrust back the locking member during engagement of the shoe within the ski binding, it is possible to provide an inclined face at the front end of the shoe. On completion of engagement of the ski shoe, a nose carried by the locking member engages and locks within a recess formed above said inclined face.

As an advantageous feature, the fastening contour of the front portion of the ski shoe comprises a pair of vertically extending grooves whilst complementary projections of the shoe-retaining stirrup are adapted to penetrate into said grooves.

The ski binding device preferably comprises an elastically deformable element so arranged as to set up a progressively increasing resistance to the pivotal movement of the shoe-retaining stirrup. Said element is preferably detachable.

For the sake of simplicity of construction, the locking member can be designed in the form of a lever which is pivotally mounted on the same axis or cross-pin as the shoe-retaining stirrup. In this case, both the shoe-retaining stirrup and the locking member rotate together as a single unit while the skier is ski-walking. It is accordingly possible to cause the elastically deformable element to act in opposition to the locking member in order to set up resistance to the pivotal displacement of the assembly.

The locking member is advantageously provided with a recess to which the tip of a ski stick can be applied in order to facilitate disengagement of the shoe from the ski binding.

In order to ensure that the ski shoe is securely maintained in the lateral direction within the shoe-retaining stirrup, said stirrup can be provided with a pair of longitudinal ribs adapted to cooperate with lateral flanks formed in the sole of the ski shoe.

Other features of the invention will be more apparent to those skilled in the art upon consideration of the following description and accompanying drawings, wherein.

Figure 1:
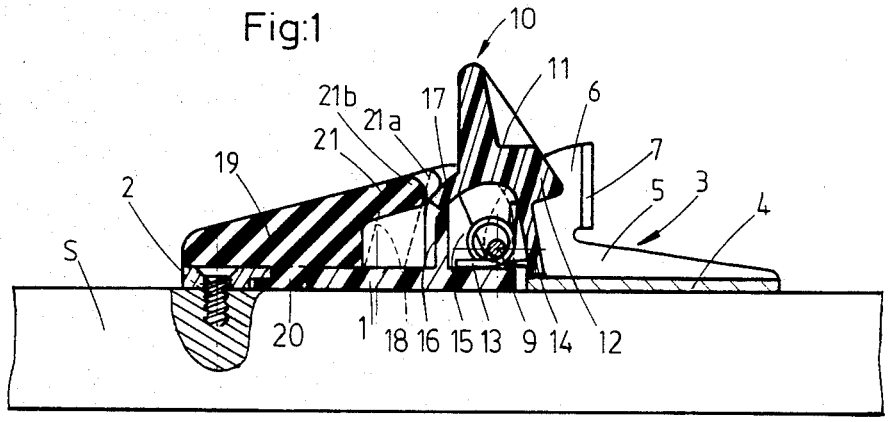
FIG. 1 is a side cross-sectional view of the ski binding device mounted on a ski, taken along the longitudinal vertical plane I—I of FIG. 2.
Figure 5:
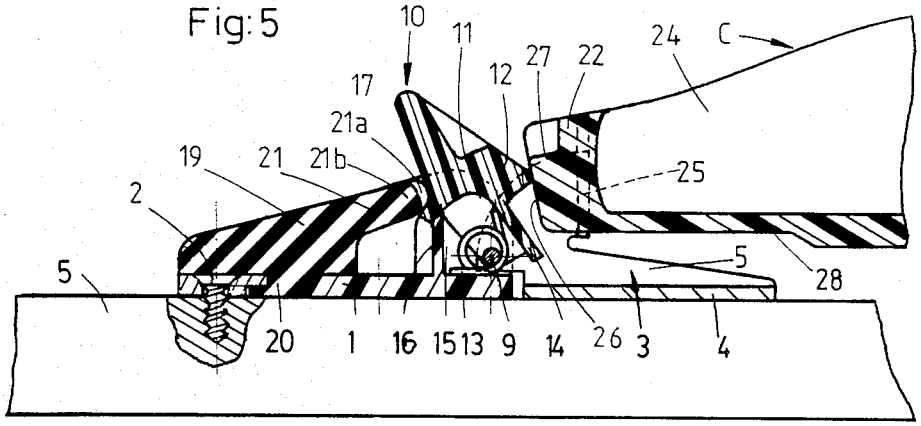
FIG. 5 is a view which is similar to FIG. 1 and shows the operation which consists in positioning the ski shoe in the ski binding.
Figure 6:
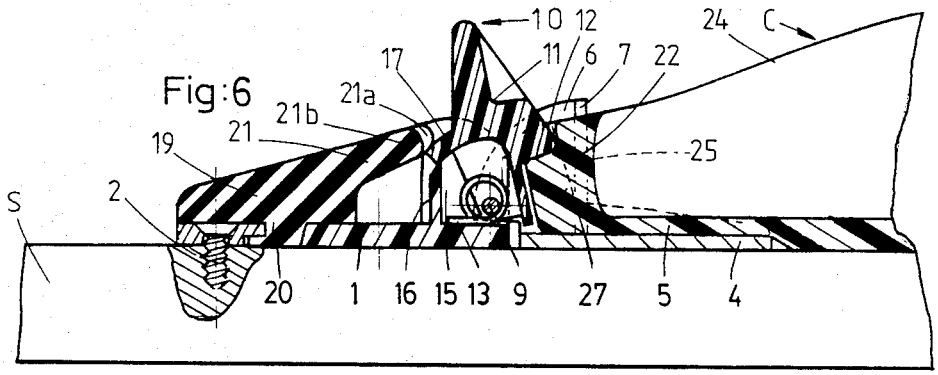
FIG. 6 is similar to FIG. 5 but shows the ski shoe after positioning in the ski binding.
Figure 7:
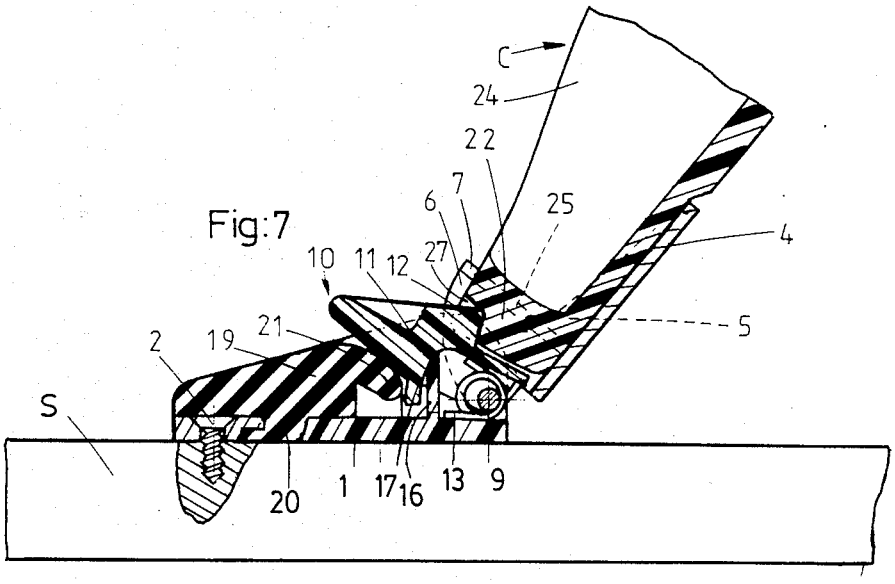
Figure 8:
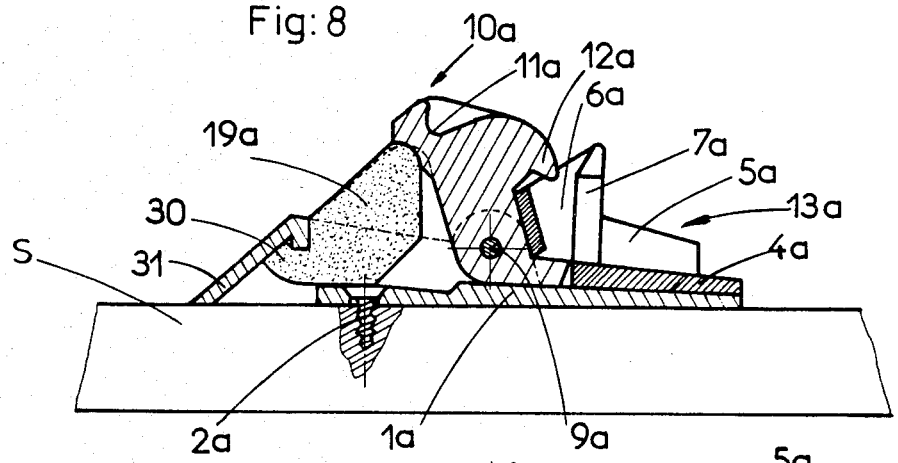
Figure 9:
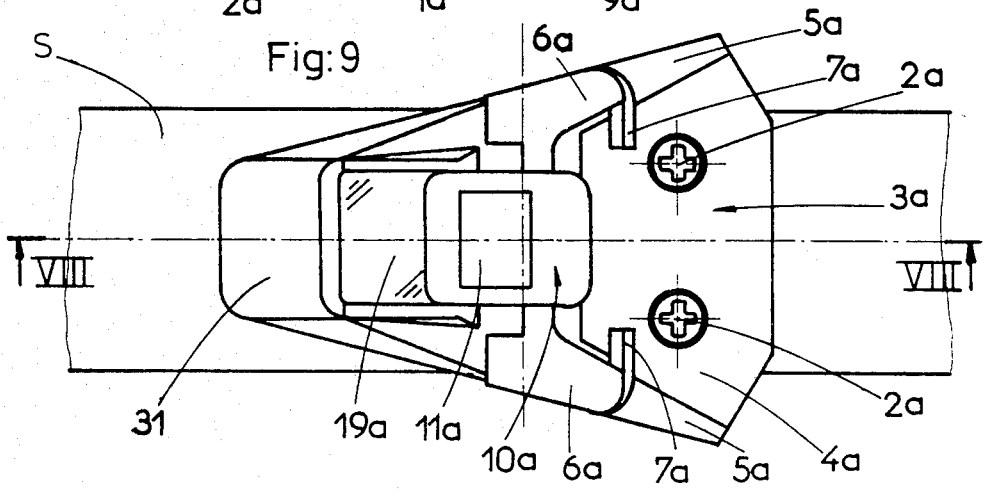
Figure 10:
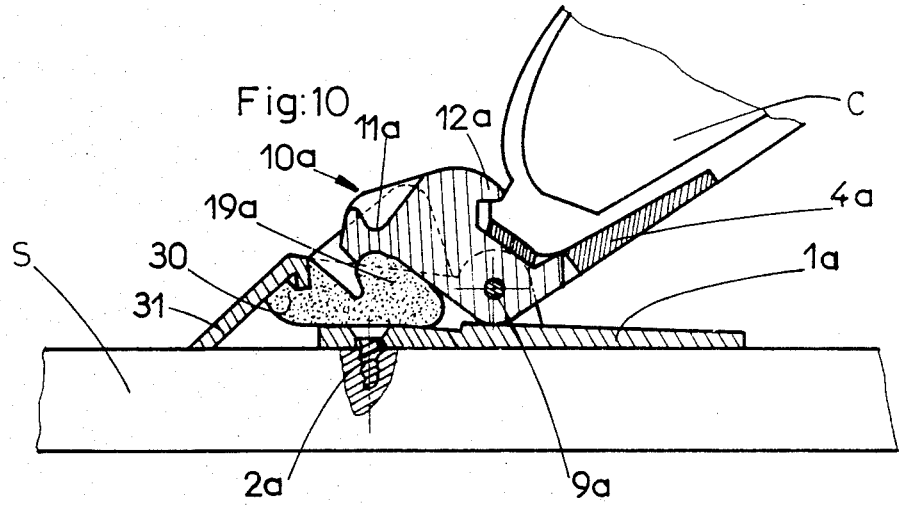

FIG. 7 which is similar to FIGS. 5 and 6 shows the assembly in a position of use (skiing stride);

FIG. 8 is a view which is similar to FIG. 1 but shows another embodiment of the ski binding device according to the invention;

FIG. 9 is a top view of the device of FIG. 8;

FIG. 10 is a view in cross-section which is similar to FIG. 8 but shows the assembly in the position of use (skiing stride).

Figure 2:
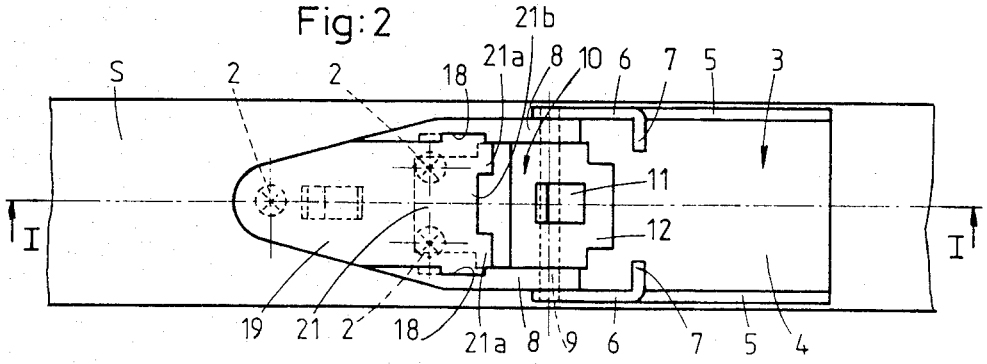
FIG. 2 is a top view of the device shown in FIG. 1.

The binding device or "ski binding" shown in FIGS. 1 and 2 comprises a base plate 1 fixed on a ski S by means of three screws 2. The ski binding further comprises a shoe-retaining stirrup 3 constituted by a horizontal plate 4, said plate being delimited by lateral flanges 5, 6 which extend vertically along the edges of the ski. The front flanges 6 (which are directed towards the left-hand side of the figures) are of greater height than the rear flanges 5. The rear portion of the lateral flanges 6 which is located above the flanges 5 is bent-back at right angles towards the interior of the ski in order to form vertical and transverse projections 7.

The base plate 1 is provided with a pair of lateral cheeks 8 which extend vertically and are placed between the flanges 6 of the shoe-retaining stirrup 3 which thus performs the function of a yoke. A cross-pin 9 passes through the cheeks 8 and the flanges 6 of the stirrup 3 and thus serves as a pivot-pin for said stirrup. Between the cheeks 8 is mounted a locking member 10 in the form of a lever which is also pivotally mounted on the cross-pin 9. It will be noted that the cross-pin 9 is located at a short distance above the ski S. The top portion of the locking lever 10 is provided with a recess 11, the opening of which is directed upwards and towards the rear end of the ski whilst the rear portion of the locking lever 10 carries a rearward projection or nose 12.

Around the cross-pin 9 is placed a torsion spring 13, one terminal arm of which is applied against the plate 1 and the other terminal arm of which is applied against the locking lever 10. The function of said spring is to subject the lever 10 to a clockwise pivotal displacement about the pivot-pin 9. This movement of pivotal displacement is limited by reason of the fact that a portion 14 of the lever 10 which is located beneath the nose 12 is abuttingly applied against the plate 4 of the shoe-retaining stirrup 3 which is in turn applied against the ski. The spring 13 is located within the interior of a cavity 15 which is isolated from the environment (snow, ice, mud, and so on) by means of two superposed sealing tongues 16, 17 formed respectively on the base plate 1 and on the locking lever 10. Grooves 18 forming slideways are cut in the internal walls of the cheeks 8 and are disposed at a slightly oblique angle with respect to the vertical. An element 19 of elastically deformable material such as synthetic rubber is embedded in the slideways 18 so as to fill the space between the cheeks 8. The lower portion of the element 19 is adapted to carry an elastic lug 20 and this latter is intended to penetrate into a recessed opening of the base plate 1 which has the function of retaining said lug.

The underside of the rear portion of the elastic element 19 is hollowed-out, with the result that this portion assumes the shape of a tongue 21 which extends above the ski towards the locking lever 10. The lateral edges 21*a* of the tongue 21 are of slightly greater length than its central portion 21*b*.

Figure 3:
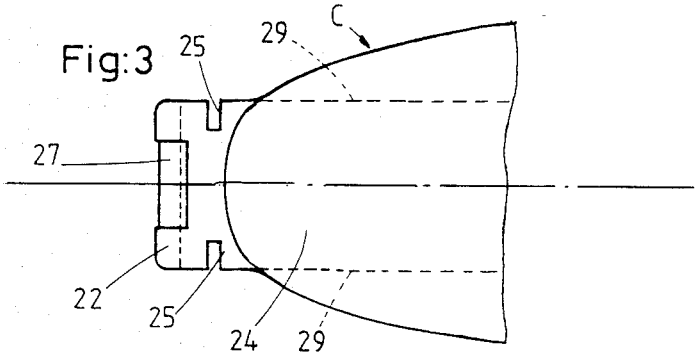
FIG. 3 is a top view of the front portion of the ski shoe.
Figure 4:
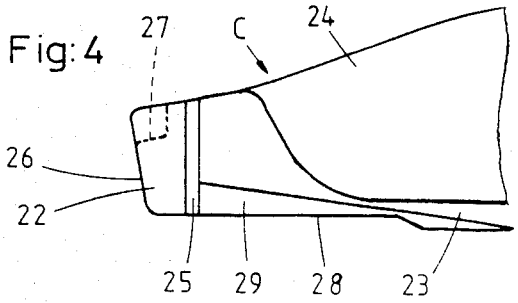
FIG. 4 is a side view of the portion of ski shoe shown in FIG. 3.

The cross-country ski shoe which is intended to cooperate with the ski binding just described is illustrated in FIGS. 3 and 4. Said ski shoe C has a front portion or toe block 22 which forms an integral part of the sole 23 and projects to a slight distance from the front end of the shoe upper 24. Said toe block 22 extends upwards from the sole 23 to the full height of the upper and is provided with two lateral grooves 25. Said grooves constitute a fastening contour which is intended to cooperate with the projections 7 of the ski binding as will be explained hereinafter. The toe block 22 has a front face 26 which is inclined at a slight angle and in the rearward direction from the top. A central recess 27 is formed in the top face of the toe block 22.

The assembly operates as follows:

In order to place the ski shoe in position in the ski binding, the skier presents the toe block 22 of the ski shoe above the stirrup 3 so that the grooves 25 are located opposite to the projections 7 of the stirrup. As a result of a downward thrust exerted by the skier's toe, the grooves 25 engage over the projections 7 whilst the inclined front face 26 which acts in the same manner as a ramp pushes back the locking lever 10 in the forward direction in opposition to the spring 13. The front portion of the sole is slightly recessed in order to compensate for the thickness of the plate 4 of the stirrup 3. When the underface 28 of said front portion comes into contact with said plate, the locking nose 12 engages and locks automatically within the recess 27 under the thrust of the spring 13.

This operation is shown in FIGS. 5 and 6.

During ski-walking as shown in FIG. 7, lifting of the skier's heel produces a pivotal displacement of the shoe-retaining stirrup 3 and of the locking member 10 about the pivot-pin 9 in the anticlockwise direction. During this stage, the spring 13 is first stressed in torsion. The front wall of the lever 10 then comes up against the edges 21*a* of the tongue 21, thus producing relatively easy deformation of said edges. The tongue 21 itself is then subjected to progressive flexural deformation. The elastic resistance to lifting of the heel therefore becomes progressively greater, the amplitude of heel lift being limited to an angle of approximately 90 degrees. At this angle, the tongue 21 is subjected to maximum flexure and compression. On completion of a stride, the tongue 21 undergoes expansion, thus assisting the downward return of the heel onto the ski.

It will be noted that the front portion of the sole is provided with vertical flanks 29 which are engaged between the flanges 5 of the stirrup 3 in the engaged position of the ski shoe. By virtue of this arrangement, the shoe is perfectly maintained within the stirrup 3 in the lateral direction and excellent guiding of the ski is thus ensured.

In order to carry out disengagement of the shoe from the ski binding, it is only necessary to displace the shoe-release lever 10 in the forward direction either by hand or by exerting pressure with the tip of the ski stick within the lever recess 11 and to withdraw the front portion of the shoe from the stirrup 3 by lifting the toe end of the shoe whilst the heel bears on the ski.

This cross-country ski assembly is of simple design whilst at the same time providing efficient performance. The pivot-pin 9 located immediately in front of the toe block and very low down on the ski is in the ideal position. The distance of projection of the toe block 22 is very small and in no way constitutes any hindrance to the skier in activities other than skiing.

Since the elastic element 19 is detachable by disengagement from the base plate 1, it can be replaced by another element having a different degree of hardness in order to adapt the element to the style of the skier and/or to the type of cross-country course to be followed.

FIGS. 8 to 10 illustrate another embodiment of the ski binding device under consideration. In this embodiment, provision is made for an elastic element 19*a* which alone assumes the functions previously assigned to the elastic element 19 and to the spring 13 and which works in compression and not in flexural deformation while skiing is in progress.

However, the general design concept of the ski binding device remains the same as before, so that the different components of this device are designated by the same reference numerals followed by the index "a".

The single elastic element 19*a* provided in this embodiment consists of a pad of elastic material such as cellular polyurethane, for example. This pad is placed above the base plate 1*a* of the corresponding device and its front end 30 is engaged within a retaining end-piece 31 which is integral with said base plate. Said elastic element tends to thrust back the locking lever 10*a* to the position of retention of the ski shoe C, thereby dispensing with the need for an additional spring such as the spring 13 provided in the preceding embodiment.

However, said elastic element also assumes the function which had previously devolved upon the elastic element 19 in the preceding embodiment. While ski-walking takes place, the lifting movement of the heel of the ski shoe produces a pivotal displacement of the shoe-retaining stirrup 3*a* and of the locking member 10*a* about the axis 9*a* in the anticlockwise direction. The stirrup 3*a* and the locking member 10*a* thus exert pressure on the elastic pad 19*a* and this latter is compressed. The elastic resistance set up in opposition to the lifting movement of the heel therefore increases to a progressively greater extent. At the end of a stride, the elastic pad 19*a* expands, thus assisting the heel in its movement of downward return onto the ski.

As in the preceding embodiment, disengagement of the shoe from the ski binding is effected by displacing the lever 10*a* in the forward direction either by hand or by exerting pressure with the tip of a ski stick in the recess 11*a* of said lever. It is apparent that this operation is performed in opposition to the pressure exerted by the single elastic element 19*a* provided in this embodiment.

The corresponding ski binding device therefore has the same operating characteristics and advantages as the device shown in FIGS. 1 to 7.

What is claimed is:

1. A cross-country skiing assembly comprising a ski shoe and a device for fixing said shoe on a ski, in which the front portion of the ski shoe has a fastening contour when looking from above whilst the ski binding device comprises a shoe-retaining stirrup provided with fastening means of complementary shape, wherein the shoe-retaining stirrup is pivotally mounted on the ski by means of a transverse pivot-pin placed immediately in front of the tip of the ski shoe, and a locking member acted upon by an elastic element and adapted to cooperate with the front portion of the ski shoe in such a manner as to permit automatic positioning of said shoe by downward engagement within the shoe-retaining stirrup and to prevent withdrawal of said shoe under an upwardly directed force, the front portion of the ski shoe having an inclined front face which is capable of thrusting back the locking member during positioning of the shoe and is provided with a top recess for receiving a nose of said locking member by snap-action engagement after positioning of the front end of said shoe within said shoe-retaining stirrup.

2. A cross-country skiing assembly according to claim 1, wherein the fastening contour of the front portion of the ski shoe comprises a pair of vertically extending lateral grooves whilst the complementary fastening means of the shoe-retaining stirrup consist of transverse projections directed towards the interior of the ski.

3. A cross-country skiing assembly according to claim 1, wherein the ski binding device comprises an elastically deformable element so arranged as to set up a progressively increasing resistance to the pivotal movement of the shoe-retaining stirrup about its pivot-pin in the direction corresponding to lifting of the heel of the ski shoe.

4. A cross-country skiing assembly according to claim 3, wherein the elastic element is detachably mounted in the ski binding device.

5. A cross-country skiing assembly according to claim 1, wherein the locking member is a lever which is pivotally mounted on the same pivot-pin as the shoe-retaining stirrup.

6. A cross-country skiing assembly according to claim 3, wherein the elastic element acts in opposition to the locking member in order to set up resistance to the pivotal movement of the shoe-retaining stirrup.

7. A cross-country skiing assembly according to claim 1, wherein the locking member is provided with a cup-shaped recess adapted to receive the tip of a ski stick in order to facilitate disengagement of the ski shoe from the ski binding.

8. A cross-country skiing assembly according to claim 1, wherein the shoe-retaining stirrup is provided with a pair of longitudinal lateral ribs adapted to cooperate with lateral flanks formed on the sole of the ski shoe in order to securely maintain said shoe in the lateral direction.

9. A cross-country skiing assembly according to claim 1, wherein said assembly comprises a single elastic element constituted by an elastic pad which is intended to work in compression and which is capable both of maintaining the locking member in the shoe-retaining position and of setting up elastic resistance to pivotal displacement of the shoe-retaining stirrup while ski-walking is in progress.

* * * * *